US005364754A

United States Patent [19]

Kim et al.

[11] Patent Number: 5,364,754

[45] Date of Patent: * Nov. 15, 1994

[54] SILVER HALIDE PHOTOGRAPHIC EMULSIONS PRECIPITATED IN THE PRESENCE OF ORGANIC DICHALCOGENIDES

[75] Inventors: Sang H. Kim, Pittsford; Anthony Adin; Richard E. Beal, both of Rochester; Jerzy A. Budz, Fairport; Wai K. Lam; Mark A. Whitson, both of Webster, all of N.Y.

[73] Assignee: Eastman Kodak Company, Rochester, N.Y.

[ * ] Notice: The portion of the term of this patent subsequent to Jun. 8, 2010 has been disclaimed.

[21] Appl. No.: 968,548

[22] Filed: Oct. 29, 1992

Related U.S. Application Data

[63] Continuation-in-part of Ser. No. 869,670, Apr. 16, 1992, abandoned.

[51] Int. Cl.[5] ..... G03C 1/34; G03C 1/015; G03C 1/005

[52] U.S. Cl. ..... 430/569; 430/567; 430/607; 430/611; 430/613; 430/614

[58] Field of Search ..... 430/611, 607, 608, 546, 430/567, 569, 613, 614

[56] References Cited

U.S. PATENT DOCUMENTS

| | | | |
|---|---|---|---|
| 1,962,133 | 6/1934 | Brooker et al. | 430/611 |
| 2,465,149 | 3/1949 | Dersch et al. . | |
| 2,756,145 | 7/1956 | Ballard et al. | 430/607 |
| 2,948,614 | 8/1960 | Allen et al. | 430/446 |
| 3,043,696 | 7/1962 | Herz et al. | 430/603 |
| 3,057,725 | 10/1962 | Herz et al. | 430/611 |
| 3,062,654 | 11/1962 | Allen et al. | 430/603 |
| 3,128,186 | 4/1964 | Corben et al. | 430/611 |
| 3,397,986 | 8/1968 | Millikan et al. | 430/603 |
| 3,563,754 | 2/1971 | Jones et al. | 430/570 |
| 4,006,025 | 2/1977 | Swank et al. | 430/580 |
| 4,379,837 | 4/1983 | Lapp et al. | 430/434 |
| 4,468,454 | 8/1984 | Brown | 430/569 |
| 4,474,872 | 10/1984 | Onishi et al. | 430/512 |
| 4,607,000 | 8/1986 | Gunther | 430/428 |
| 4,713,322 | 12/1987 | Bryan et al. | 430/569 |
| 4,749,646 | 6/1988 | Herz et al. | 430/569 |
| 4,826,758 | 5/1989 | Yoshida et al. | 430/569 |
| 4,912,017 | 3/1990 | Takagi et al. | 430/264 |
| 5,217,859 | 6/1993 | Boettcher et al. | 430/569 |
| 5,219,721 | 6/1993 | Klaus et al. | 430/569 |
| 5,229,264 | 7/1993 | Pätzold et al. | 430/567 |

*Primary Examiner*—Charles L. Bowers, Jr.
*Assistant Examiner*—Mark F. Huff
*Attorney, Agent, or Firm*—Sarah Meeks Roberts

[57] ABSTRACT

This invention provides a method of preparing a silver halide photographic emulsion which comprises adding to the silver halide emulsion before or during precipitation a non-labile chalcogen compound represented by Formula I:

$$R^1—X^1—X^2—R^2 \quad \text{(Formula I)}$$

It further provides a silver halide photographic emulsion prepared by the above method.

18 Claims, No Drawings

SILVER HALIDE PHOTOGRAPHIC EMULSIONS PRECIPITATED IN THE PRESENCE OF ORGANIC DICHALCOGENIDES

This application is a continuation-in-part of co-pending U.S. application Ser. No. 07/869,670 filed Apr. 16, 1992, now abandoned.

FIELD OF THE INVENTION

This present invention relates to light sensitive silver halide emulsions. In particular, it relates to light sensitive silver halide emulsions precipitated in the presence of organic dichalcogenides.

BACKGROUND OF THE INVENTION

Problems with fogging have plagued the photographic industry from its inception. Fog is a deposit of silver or dye that is not directly related to the image-forming exposure, i.e., when a developer acts upon an emulsion layer, some reduced silver is formed in areas that have not been exposed to light. Fog can be defined as a developed density that is not associated with the action of the image-forming exposure, and is usually expressed as "Dmin", the density obtained in the unexposed portions of the emulsion. A density, as normally measured, includes both that produced by fog and that produced by exposure to light.

It is known in the art that the appearance of photographic fog related to reduction of silver ion can occur during many stages of preparation of the photographic element including silver halide emulsion preparation, (spectral) chemical sensitization of the silver halide emulsion, melting and holding of the liquid silver halide emulsion melts, subsequent coating of silver halide emulsions, and prolonged natural and artificial aging of coated silver halide emulsions. Particularly, silver halide emulsions precipitated in the presence of ripeners such as thioethers or ammonia and/or in environments sensitive to reduction of silver ions such as high pH and/or low pAg usually suffer from high fog and poor raw stock keeping (RSK).

Several methods have been employed to minimize this appearance of fog. Mercury containing compounds, such as those described in U.S. Pat. Nos. 2,728,663; 2,728,664; and 2,728,665, have been used as additives to combat fog. Thiosulfonate and thiosulfonate esters, such as those described in U.S. Pat. Nos. 2,440,206; 2,934,198; 3,047,393; and 4,960,689, have also been employed.

Aromatic, heterocyclic, and acyclic disulfides which do not have labile sulfur or sulfide, such as those described in U.S. Pat. Nos. 1,962,133; 2,465,149; 2,756,145; 3,043,696; 3,057,725; 3,062,654; 3,128,186; and 3,563,754, have been used primarily as emulsion melt additives, i.e., being introduced into already (spectral) chemically sensitized silver halide emulsions prior to coating. U.S. Pat. No. 3,397,986 discloses bis(p-acylamidophenyl)disulfides as useful antifoggants added before or after any optically sensitizing dyes. However, the use of optically sensitizing dyes during chemical sensitization was not readily known in the art until their widespread use during tabular shaped silver halide emulsion sensitization. U.S. Pat. No. 3,397,986 and the others cited previously did not anticipate the utility of these non-labile disulfides during the sensitization of silver halide emulsions, either with or without optically sensitizing dyes. The prior art use of these disulfides as melt additives does decrease fog and stabilize against fog during aging of coated emulsions, but when used in this manner also decreases sensitivity and requires the use of additional stabilizers like azaindenes, such as described in U.S. Pat. No. 3,859,100.

Another challenge in the manufacture of photographic emulsions is the control of the shape and size of the silver halide grains. Morphology (crystal shape) of silver halide emulsion grains plays an important role in their photographic applications. For example, high aspect ratio tabular grain silver haloiodide emulsions have been recognized to provide a variety of photographic advantages, such as improved speed-granularity relationships, increased image sharpness, and reduced blue speed of minus blue recording emulsion layers as illustrated in Kofron et al, U.S. Pat. No. 4,439,520. Research Disclosure 25330, published by Kenneth Mason Publications, Ltd., Dudley Annex, 12a North Street, Emsworth, Hampshire P010 7DQ, ENGLAND, by Buhr et al, discloses how to utilize optical properties of tabular emulsions for optimizing photographic responses of specific layers depending on their grain thicknesses.

Silver chloride crystals are mostly of cubic morphology bound by (100) faces when precipitated under standard conditions. In some cases, other faces may appear. It is most common, however, that (111) and perhaps (110) crystallographic faces occupy only a small fraction of the total crystal surface. The relative amount of those faces may depend on the presence of selective growth modifiers, which would be able to slow down the growth of fast growing faces like (111) and (110). Such growth modifiers are known in the art; W. Reinders, "Study of Photohalides III, Absorption of Dyes, Proteins, and Other Organic Compounds in Crystalline Silver Chloride", *Zeitschrift fur Physikalische Chemie,* volume 77, pages 677–699 (1911), J. Maskaski CA 1,280,312 and references therein. It is also known that different crystallographic faces respond differently to chemical sensitization. Therefore, it is desirable to be able to control some aspects of chemical sensitization with crystal morphology.

T. H. James, "The Theory of the Photographic Process", pages 98–100, Fourth Edition, Macmillan Publishing Company, Inc., New York (1977), describes how various crystal morphologies are formed in different grain formation conditions such as in an excess of bromide ions and solvents such as ammonia. As an example, AgBrI emulsions can be made in various morphologies depending on pAg (silver ion activity). "Particle growth in Suspensions", page 159, Academic Press, London, (1973), discusses growth modifying agents including cationic surfactants and thioureas as growth accelerators and 1-phenyl-5-mercaptotetrazole (PMT), 4-hydroxy-6-methyl-1,3,3a,7-tetraazaindene (TAI) and certain cyanine dyes as growth restrainers. U.S. Pat. No. 4,749,646 (Herz et al) discloses the use of a 1,1,3,3-tetrasubstituted middle chalcogen urea compound as an effective grain growth modifying agent.

U.S. Pat. No. 4,912,017 (Y. Takagi and S. Nishiyama) discloses the use of sulfur-containing compounds such as PMT and mercaptothiadiazoles and thio-ketone group containing compounds to prevent grain size fluctuation (development unevenness) after formation of grains. It also discloses the use of disulfide compounds which are easily cleavable into the above compounds. These compounds can allegedly adsorb to the surface of silver halide crystals. This patent teaches that the preferred point of addition is during the preparation of a diluted coating emulsion.

There is a continuing need for methods of improving the fog characteristics of photographic emulsions. Further, there is a continuing need for additional methods of controlling grain formation to improve photoefficiency. In accordance with this invention, it has been found that the addition of certain organic dichalcogenides during precipitation of a silver halide emulsion can modify the grain growth of silver halide crystals. This allows the independent control of surface morphology, thickness, size, and dispersity.

It has also been found that the addition of these same dichalcogenide compounds to a silver halide emulsion during precipitation gives lower fog without a concomitant large loss in sensitivity. It has further been found that equivalent fog reduction can be obtained with less dichalcogenide when the dichalcogenide is used during precipitation, rather than as a melt additive, and that less or no latent image destabilization occurs. Additionally, less loss in sensitivity occurs after aging of the coated emulsions.

SUMMARY OF THE INVENTION

This invention provides a method of making a photographic silver halide emulsion comprising precipitating a silver halide emulsion and adding to the silver halide emulsion before or during precipitation a non-labile chalcogen compound represented by Formula I:

$$R^1—X^1—X^2—R^2 \qquad \text{(Formula I)}$$

where $X^1$ and $X^2$ are independently S, Se, or Te; and $R^1$ and $R^2$, together with $X^1$ and $X^2$, form a ring system, or are independently substituted or unsubstituted cyclic, acyclic or heterocyclic groups.

In one embodiment, the dichalcogenide compound is a disulfide compound represented by Formula II or III.

(Formula II)

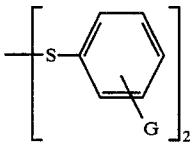

In Formula II, G is independently in an ortho, meta, or para position on the aromatic nucleus relative to the sulfur and is hydrogen, hydroxy, $SO_3M$ or $NR^3R^4$;

M is hydrogen, or an alkaline earth, alkylammonium or arylammonium cation;

$R^3$ is hydrogen, or a substituted or unsubstituted alkyl or aryl group;

$R^4$ is hydrogen, O=C—$R^5$, or O=C—N—$R^6R^7$; and $R^5$, $R^6$, and $R^7$ are independently hydrogen, or hydroxy, or an unsubstituted alkyl, or aryl group, or a substituted or unsubstituted fluoroalkyl, fluoroaryl, carboxyalkyl, carboxyaryl, alkylthioether, arylthioether, sulfoalkyl, or sulfoaryl group or the free acid, alkaline earth salt or alkylammonium or arylammonium salt of the aforementioned groups.

(Formula III)

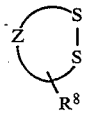

In Formula III, Z contains substituted or unsubstituted carbon or hetero atoms sufficient to form a ring; and $R^8$ is a substituted or unsubstituted alkyl or aryl group of 2 to 10 carbon atoms, or the free acid, alkaline earth salt, arylammonium or alkylammonium salt of the aforementioned groups.

In other embodiments, the silver halide emulsion may be a reduction sensitized or a doped emulsion. In a further embodiment, the dichalcogenide compound is added to the silver halide emulsion as a solid particle dispersion.

This invention further provides a photographic silver halide emulsion prepared by the method described above.

DETAILED DESCRIPTION OF THE INVENTION

The dichalcogenic compounds of this invention are represented by Formula I:

$$R^1—X^1—X^2—R^2 \qquad \text{(Formula I)}$$

In the above formula, $X^1$ and $X^2$ are independently S, Se, or Te; and $R^1$ and $R^2$, together with $X^1$ and $X^2$, form a ring system, or are independently substituted or unsubstituted cyclic, acyclic or heterocyclic groups. Preferably, the molecule is symmetrical and $R^1$ and $R^2$ are alkyl or aryl groups. Preferred is the combination of $R^1$ and $R^2$ resulting in a dichalcogenide with a molecular weight greater than 210 g/mol. $R^1$ and $R^2$ cannot be groups which cause the compound to become labile, such as, for example,

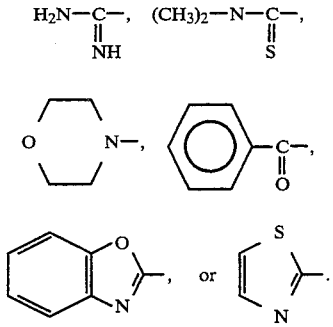

Examples of preferred compounds are shown below:

EXAMPLES OF FORMULA I $R^1—X^1—X^2—R^2$

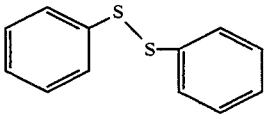

-continued

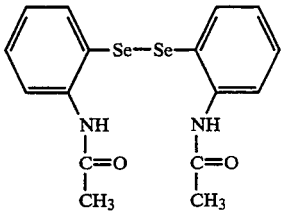

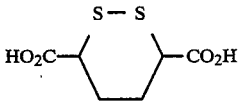

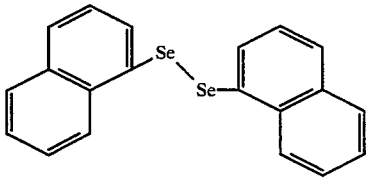

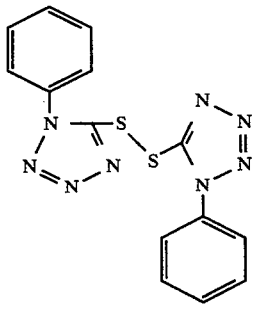

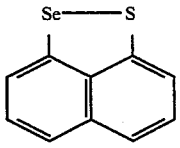

$Ho_2C(CH_2)_4$—Se—Se—$(CH_2)_4CO_2H$

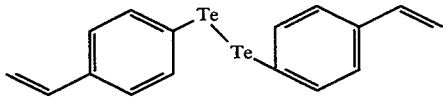

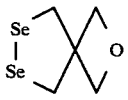

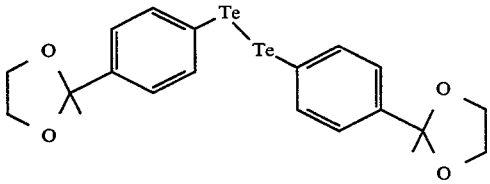

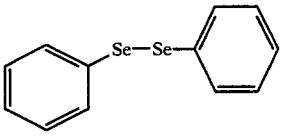

-continued

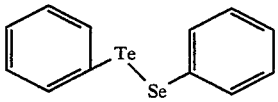

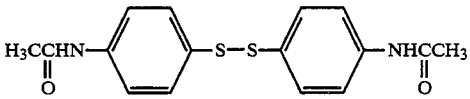

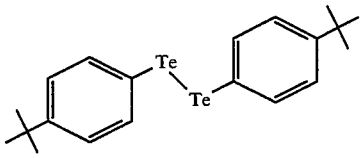

The dichalcogen must be non-labile, meaning it does not release elemental chalcogen or chalcogen anion under specified conditions for making conventional photographic emulsions or the resulting photographic element.

Preferably, the dichalcogenide compound is a disulfide compound represented by Formula II or III.

(Formula II)

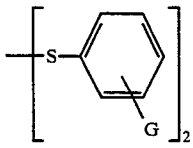

In Formula II, G is independently in an ortho, meta, or para position on the aromatic nucleus relative to the sulfur. More preferably, the molecule is symmetrical and most preferably G is in the para position. G is hydrogen, hydroxy, $SO_3M$ or $NR^3R^4$. More preferably, G is $NR^3R^4$.

M is hydrogen, or an alkaline earth, alkylammonium or arylammonium cation. Preferably, M is hydrogen or sodium, and more preferably, M is sodium. $R^3$ is hydrogen, or a substituted or unsubstituted alkyl or aryl group. Preferred substituents on the alkyl or aryl groups of $R^3$ may be methyl, amino, carboxy, or combinations thereof. The preferred groups contain up to 20, and more preferably, up to 10 carbon atoms. Examples of suitable groups are trifluoromethyl, methyl, ethyl, propyl, phenyl, and tolyl.

$R^4$ is hydrogen, O=C—$R^5$, or O=C—N—$R^6R^7$. More preferably, $R^4$ is hydrogen, or O=C—$R^5$.

$R^5$, $R^6$, and $R^7$ are independently hydrogen, or hydroxy, or an unsubstituted alkyl, or aryl group, or a substituted or unsubstituted fluoroalkyl, fluroaryl, carboxyalkyl, carboxyaryl, alkylthioether, arylthioether, sulfoalkyl, or sulfoaryl group or the free acid, alkaline earth salt or alkylammonium or arylammonium salt of the aforementioned groups. Examples of suitable groups are trifluoromethyl, methyl, ethyl, n-butyl, isobutyl, phenyl, naphthyl, carboxymethyl, carboxypropyl, carboxyphenyl, oxalate, terephthalate, methylthiomethyl, and methylthioethyl.

In a more preferred embodiment, $R^3$ is a hydrogen or methyl and $R^4$ is O=C—$R^5$. $R^5$ is preferably an alkyl group of 1 to 10 carbon atoms, an aryl group of 6 to 10 carbon atoms, or a trifluoromethyl group. Most preferably, the disulfide compound is p-acetamidophenyl disulfide.

Examples of preferred disulfide compounds are listed in Table 1.

TABLE I

| Examples of Formula II* Designation; Position, and Substituent Structure of G | | |
|---|---|---|
| II-1 | para | $N(H)C(O)CH_3$ |
| II-2 | meta | $N(H)C(O)CH_3$ |
| II-3 | ortho | $N(H)C(O)CH_3$ |
| II-4 | para | $NH_2 \times HCl$ |
| II-5 | para | N(H)C(O)H |
| II-6 | ortho | N(H)C(O)H |
| II-7 | para | $N(H)C(O)CF_3$ |
| II-8 | ortho | $N(H)C(O)CF_3$ |
| II-9 | para | N(H)C(O)-phenyl |
| II-10 | para | N(H)C(O)-ethyl |
| II-11 | para | N(H)C(O)-propyl |
| II-12 | para | N(H)C(O)-naphthyl |
| II-13 | para | $N(H)C(O)C_7H_{15}$ |
| II-14 | para | $N(H)C(O)C_{14}H_{29}$ |
| II-15 | para | $N(H)C(O)C_{17}H_{35}$ |
| II-16 | para | $N(H)C(O)CH_2—S—C_{12}H_{25}$ |
| II-17 | para | $N(H)C(O)CH_2—S—CH_3$ |
| II-18 | para | $N(H)C(O)C_2H_4—S—CH_3$ |
| II-19 | para | $N(H)C(O)CH_2(CH_3)—S—CH_3$ |
| II-20 | para | N(H)C(O)-phenyl(2-$SO_3Na$) |
| II-21 | para | $N(H)C(O)C(CH_3)_3$ |
| II-22 | para | N(H)C(O)-phenyl(4-$CO_2CH_3$) |

*atoms in parentheses in structure indicate they are substituted to the atom on the left.

(Formula III)

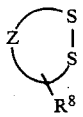

In Formula III, Z contains substituted or unsubstituted carbon or hetero atoms sufficient to form a ring. The preferred heteroatom is nitrogen. Most preferably, Z contains all carbon atoms. Preferred substituents on Z may be, for example, methyl, ethyl, or phenyl groups. $R^8$ is a substituted or unsubstituted alkyl or aryl group of 2 to 10 carbon atoms, and more preferably, 4 to 8 carbon atoms, or the free acid, alkaline earth salt, or the alkylammonium or arylammonium salt of the aforementioned groups. Preferably, $R^8$ is a substituted or unsubstituted carboxyalkyl, carboxyaryl, alkyl ester, or aryl ester group. Examples of appropriate substituents include alkyl and aryl groups.

More preferably, Z comprises four carbon atoms and $R^8$ is an alkyl or carboxyalkyl group of 4 to 8 carbon atoms, or the free acid, alkaline earth salt or ammonium salt of the aforementioned groups. The most preferred disulfide compounds of general Formula III are 5-thioctic acid and 6-thioctic acid. Examples of Formula III are the following:

(III-1)

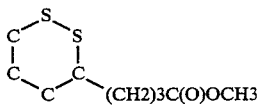

(III-2)

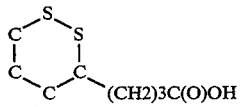

-continued (III-3)

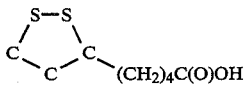

The dichalcogenide compounds of this invention can be prepared by the various methods known to those skilled in the art.

Photographic emulsions are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are chemically and spectrally sensitized, as known in the art. Chemical sensitization of the emulsion employs sensitizers such as sulfur-containing compounds, e.g., allyl isothiocyanate, sodium thiosulfate and allyl thiourea;. reducing agents, e.g., polyamines and stannous salts; noble metal compounds, e.g., gold, platinum and diethylsenide; and polymeric agents, e.g., polyalkylene oxides. A temperature rise is employed to complete chemical sensitization (heat spike). Spectral sensitization is effected with agents such as sensitizing dyes. For color emulsions, dyes are added in the spectral sensitization step using any of a multitude of agents described in the art. It is known to add such dyes both before and after the heat spike.

After spectral sensitization, the emulsion is coated on a support. Various coating techniques include dip coating, air knife coating, curtain coating, and extrusion coating.

The dichalcogen compounds of this invention can be added to the vessel containing the aqueous gelatin salt solution before the start of the precipitation; they can also be added during precipitation to the salt solution, the silver nitrate solution, or from a separate jet directly into the kettle. Addition through the silver nitrate solution may be preferred in some cases because the dichalcogen compounds are more soluble in such a solution. However, there is some indication that greater activity may be achieved if the dichalcogens are added in the salt solution or directly to the vessel before the start of precipitation. The compounds can be added from the beginning or part-way-through precipitation, however, they must be added before the end of precipitation.

The dichalcogenide compounds of this invention can be added before or during the precipitation of the silver halide emulsion using any technique suitable for this purpose. They can be added from solutions or as solids. For example, they can be dissolved in a suitable solvent and added directly to the precipitating solutions, or they can be added in the form of a liquid/liquid dispersion similar to the technique used with certain couplers. Examples of suitable solvents or diluents include methanol, ethanol, or acetone. Parameters such as temperature, stirring time, and other variables for precipitating conventional emulsions are known to those skilled in the art.

It is believed that the most preferred method of addition may be as a solid particle dispersion added directly to the kettle. Unexpectedly, it had been found that addition of the dichalcogenides using this method results in significantly greater antifogging activity. The aqueous, solid particle dispersions are prepared by milling an aqueous slurry of dichalcogenide and surfactant using known milling technology. Examples of suitable milling equipment include a ball milling and a SWECO mill. Descriptions of other general milling techniques which may be used with this invention may be found in Patton, Temple C. Paint Flow and Pigment Dispersion, Second Edition, Wiley-Interscience, New York, 1979, hereafter referred to as Patton.

Examples of milling media are zirconium oxide beads or silicon carbide sand. The milling temperature may be room temperature or slightly higher (<30° C.). Appropriate surfactants include, among others, Triton® X-200 (Rohm & Haas Company, Philadelphia, Pa.) an alkylated arylpolyether sulfonate and other anionic surfactants.

Following milling, the slurry is separated from the media by coarse filtration. Generally, the slurry is then diluted to working strength with a gelatin solution, although it is not necessary to do so. As an alternative, the slurry can be used directly. Sonification may be used, if necessary, to break up aggregates. Alternatively, the slurry and beads can be diluted into a gelatin solution and the beads separated from the final dispersion by coarse filtration. Characterization of the final dispersion for dichalcogenide content may be made by spectrophotometric analysis and for particle size by microscopy. For additional description of this technique, see U.S. Pat. No. 5,217,859 Boettcher et al. incorporated herein by reference.

The optimal amount of the dichalcogenide compound to be added and the point of addition will depend on the desired final result, the type of emulsion, the degree of ripening, the structure of the dichalcogenide, and other variables. In general, the concentration of dichalcogenide which is adequate is from about $1\times10^{-9}$ to about $1\times10^{-2}$ mol/mol Ag, with $1\times10^{-7}$ to $1\times10^{-2}$ mol/mol Ag being preferred. The more preferred range which gives good antifogging without reducing sensitivity is $1\times10^{-6}$ to $3\times10^{-4}$ mol/mol Ag. The more preferred range for the growth modification properties is $1\times10^{-5}$ to $1\times10^{-3}$ mol/mo Ag.

Combinations of the dichalcogenide compounds may be added, i.e., two or more of Formula II or Formula III compounds, or a combination of Formula II and III compounds. The dichalcogenide compounds also may be added in combination with other antifoggants and finish modifiers.

The method of this invention is particularly useful with intentionally or unintentionally reduction sensitized emulsions. As described in *The Theory of the Photographic Process,* Fourth edition, T. H. James, Macmillan Publishing Company, Inc., 1977, pages 151–152, reduction sensitization has been known to improve the photographic sensitivity of silver halide emulsions. Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion).

During precipitation of a silver halide emulsion, unintentional reduction sensitization can occur when silver nitrate or alkali solutions are added rapidly or with poor mixing to form emulsion grains, for example. Also, silver halide emulsions precipitated in the presence of ripeners (grain growth modifiers) such as thioethers, selenoethers, thioureas, or ammonia tend to facilitate reduction sensitization.

The reduction sensitized silver halide emulsions, prepared as described in this invention, exhibit good photographic speed but usually suffer from undesirable fog and poor storage stability.

Examples of reduction sensitizers and environments which may be used during precipitation or spectrochemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23,113 (1979).

Examples of processes for preparing intentionally reduction sensitized silver halide emulsions are described in EP 0 348934 Al (Yamashita), EP 0 369491 (Yamashita), EP 0 371388 (Ohashi,), EP 0 396424 Al (Takada), EP 0 404142 Al (Yamada) and EP 0 435355 Al (Makino).

The method of this invention is also particularly useful with emulsions doped with group VIII metals such as iridium, rhodium, iron and osmium, as described in *Research Disclosure,* December, 1989, Item 308119, published by Kenneth Mason Publications, Ltd., Dudley Annex, 12a North Street, Emsworth, Hampshire P010 7DQ, ENGLAND. It is common practice in the art to dope emulsions with these compounds for improved photographic properties such as reciprocity, sensitivity, and contrast.

A general summary of the use of iridium in the sensitization of silver halide emulsions is contained in Carroll, "Iridium Sensitization: A Literature Review", Photographic Science and Engineering, Vol. 24, No. 6, 1980. The use of iridium in precipitating an emulsion for low intensity reciprocity control is described in U.S. Pat. No. 4,997,751 (Kim). The use of osmium in precipitating an emulsion is described in U.S. Pat. No. 4,933,272 (McDugle et al.).

In some cases, when such dopants are incorporated, emulsions show an increased fresh fog and a lower contrast sensitometric curve when processed in the color reversal E-6 process, as described in The British Journal of Photography Annual, 1982, pages 201–203.

The emulsions, doped as described above with Group VIII metals, when precipitated with dichalcogenide compounds show a dramatic decrease in fresh fog and higher contrast. The high temperature storage stability of the unexposed film is also improved by the practice of this invention by reducing the change in speed.

The emulsions which show the greatest growth modification response are the tabular, cubic, and octahedral emulsions. The dichalcogenide compounds of this invention tend to restrain the surface growth of the silver halide grains causing thinner and smaller grains.

Ripeners, for example, thioether, thiourea, thiocyanate, and ammonia may be used to control size and dispersity in cubic, cubo-octahedral, octahedral; tabular, and other morphologies. Such ripened emulsions can exhibit a lack of edge and corner definition due to the silver halide solvent effect which produces rounded grains. Another limitation inherent to ripened emulsions is an inability to produce sharp phase boundaries between areas of varying halide content. The dichalcogenide compounds of this invention are particularly useful with such ripened emulsions because they provide better phase separation and more uniform crystal growth.

Morphology is also a function of pAg. For AgBrI emulsions, octahedra emulsions having <111> faces are normally formed under conditions of excess bromide ion concentration (high pAg). As the excess bromide concentration is moved toward excess silver ion concentrations (lower pAg), the morphology proceeds from tabular→octahedral→cubo-octahedral→cubic. In other words, the morphology is dependent upon the pAg conditions during the emulsion precipitation for a given halide composition. The practice of this invention causes a shift in this relationship. For example, conditions that favor formation of cubic emulsions without dichalcogenide, produce cubo-octahedra emulsions with dichalcogenide; conditions which favor cubo-octahedra emulsion without dichalcogenide, produce octahedra with dichalcogenide. The use of the dichalcogenide provides a method of independent control of grain morphology at a given pAg.

The photographic elements of this invention can be non-chromogenic silver image forming elements. They can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore, U.S. Pat. No. 4,362,806 issued Dec. 7, 1982. The element can contain additional layers such as filter layers, interlayers, overcoat layers, subbing layers and the like.

In the following discussion of suitable materials for use in the emulsions and elements of this invention, reference will be made to *Research Disclosure,* December, 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Examples of suitable emulsions and their preparation are described in Research Disclosure Sections I and II and the publications cited therein. Other examples of suitable emulsions are described in U.S. Pat. Nos. 4,997,751 (Kim) and 4,656,122 (Sowinski et al.) and U.S. application Ser. No. 699,869 (Kim et al.). Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure. The elements of the invention can include various couplers including, but not limited to, those described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof can contain among other things brighteners (Examples in Research Disclosure Section V), antifoggants and stabilizers (Examples in Research Disclosure Section VI), antistain agents and image dye stabilizers (Examples in Research Disclosure Section VII, paragraphs I and J), light absorbing and scattering materials (Examples in Research Disclosure Section VIII), hardeners (Examples in Research Disclosure Section X), plasticizers and lubricants (Examples in Research Disclosure Section XII), antistatic agents (Examples in Research Disclosure Section XIII), matting agents (Examples in Research Disclosure Section XVI) and development modifiers (Examples in Research Disclosure Section XXI).

The photographic elements can be coated on a variety of supports including, but not limited to, those described in Research Disclosure Section XVII and the references described therein.

Photographic elements can be exposed to actinic radiation, typically in the visible region of the spectrum, to form a latent image as described in Research Disclosure Section XVIII and then processed to form a visible dye image, examples of which are described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The following examples are intended to illustrate, without limiting, this invention.

EXAMPLES

The following compounds are utilized in the Examples.

Compound A = P-acetamido phenyl disulfide

Compound B = HO—CH2CH2—S—CH2CH2—S—CH2CH2—OH

Compound C = anhydro-5'-chloro-3,3'-bis(3-sulfopropyl)naptho{1,2-d}oxazolothiacyanine hydroxide triethylamine Compound D = anhydro-5,3,3'-di-(3-sulfopropyl)naphto (1,2-d)thiazolothiacyanine hydroxide Compound E = 3-Methyl benzothiazolium iodide Compound F = sodium aurous (I) dithiosulfate -continued Compound G = sodium thiosulfate pentahydrate Compound H = 4-hydroxy-6-methyl-1,3,3a,7-tetraazaindene Compound I = Benzoic acid, 4-chloro-3-{(2-(4-ethoxy-2,5-dioxo-3-(phenyl)methyl-1-imidazolidinyl)-4,4'dimethyl-1,3-dioxopropyl)amino)dodecyl ester Compound J = Benzothiazolium salt, BF4(−)

Compound K =

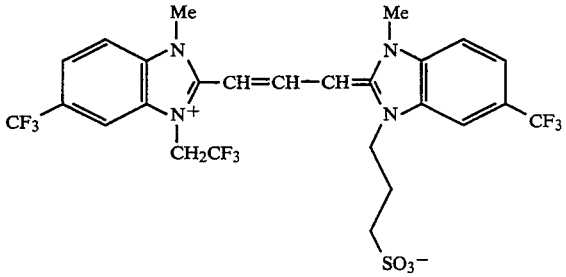

Compound L =

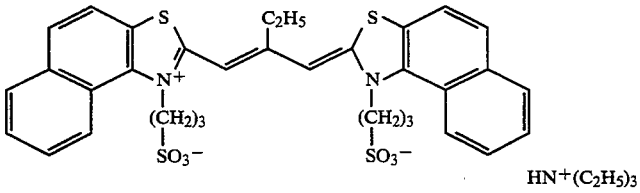

Compound M =

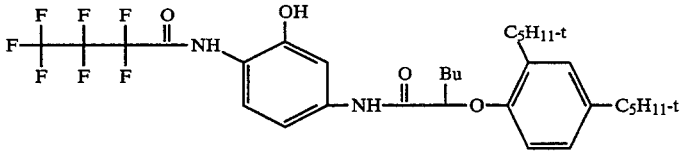

Hexanamide,2-[2,4-bis(1,1-dimethylpropyl)phenoxy]-N-[4-[(2,2,3,3,4,4,4-heptafluoro-1-oxobutyl)amino]-3-hydroxyphenyl]-

Compound N =

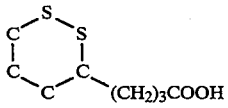

5-thioctic acid

Compound O =

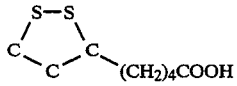

6-thioctic acid

Example 1

2.63% I bromoiodide tabular emulsions A (control) and B (invention) were precipitated by a double jet procedure. The following procedure produced 1 mole of total silver precipitation. 0.0082 mole of silver was nucleated for 1 minute with 2 N AgNO3 while maintaining the pAg at 9.2. This was done by adding a salt solution of 1.98 N NaBr and 0.02 N KI to a vessel filled with 818 cc of an aqueous solution containing 1.87 g/l bone gelatin, 2.5 g/l NaBr, 0.32 cc/l Pluronic 31R1 (tradename of BASF Wyandotte Corp.) and a block copolymer of ethylene oxide and propylene oxide, at a pH of 1.85 and a temperature of 55° C. After adjusting the pAg to 9.4 by NaBr, the temperature was raised to 75° C.; 13.85 cc of 0.77M $(NH_4)_2SO_4$ was added, and the pH was brought to 10.5 by 2.5 N NaOH. After holding for 9 minutes, the pAg was adjusted to 8.6 by the addition of an aqueous gelatin solution containing 100 g/l bone gelatin and 0.11 cc/l Pluronic 31R1 and the pH was adjusted to 3.0. The emulsion was then grown at pAg 8.4 for 64.6 minutes by accelerated flow rates of 1.6N AgNO3 and a salt solution of 1.66N NaNO3 and 0.0168N KI. At this point, which completed 71% of the total silver precipitation, a preformed AgI emulsion (0.05 μm) was added to make a total 2.63% of I. After 3 minutes, the remaining 29% of the total silver was precipitated with 1.6N AgNO3 and 3.5 N NaBr at pAg 7.7 for 15.7 minutes. 0.1 mg/Ag mole of K2IrCl6 was added after 75% of total silver precipitation. The resultant emulsion was washed by an ultrafiltration technique and the pH and pAg were adjusted to 5.5 and 8.2, respectively. For emulsion B, Compound A, dissolved in methanol, was added to the silver nitrate solution. Their grain size and thickness was compared as shown below:

| Emulsions | *Compound A | Mean Size | **COV | Mean Thickness | ***AR | ****Tabularity |
|---|---|---|---|---|---|---|
| A (Control) | None | 2.70 um | 31% | 0.135 um | 20.0 | 148 |
| B (Invention) | 24.4 | 1.74 um | 40% | 0.125 um | 13.9 | 111 |

*mg/mole silver
**coefficient of variation of total grains population
***Aspect Ratio = mean size/mean thickness
****Aspect ratio/thickness The unexpected decrease in grain size and thickness is attributed to the growth inhibition properties of Compound A. No significant change was observed when the concentration of Compound A was reduced to 2.44 mg/Ag mole.

Emulsion A was chemically sensitized with gold and sulphur, and spectrally sensitized to the blue region of the spectrum. Emulsion B was sensitized with 5% more sensitizers than emulsion A.

60 mg/ft$^2$ of the sensitized emulsions were coated with 1.75 g/silver mole of Compound H as a stabilizer, 160 mg/ft$^2$ of yellow coupler Compound I, and 220 mg/ft$^2$ of gelatin over an antihalation support.

The emulsion layer was protected by a gelatin overcoat and hardened. The coatings were exposed for 1 second with 3200K through a step wedge and Kodak Wratten filter Wr2B on a 1B sensitometer and processed to form positive images for six minutes in a color developer of the type described in the British Journal of Photography Annual, 1982, pages 201 to 203 (Kodak E6 reversal process). The speed (reversal) was determined at 0.3 below Dmax (maximum density). Fog was determined by developing a black and white image for four minutes followed by forming a negative color image as described for reversal process. After fresh testing, the coatings were kept in 120° F. and 50% relative humidity for 2 weeks for testing storage stability. Changes in Dmax and speed due to the keeping condition are expressed as % Dmax and Dspeed.

| Emulsions | *Compound A | Fog | Dmax | Speed | % Dmax | Dspeed |
|---|---|---|---|---|---|---|
| A (Control) | None | 0.11 | 1.51 | 205 | −15 | +18 |
| B (Invention) | 24.4 | 0.05 | 1.95 | 188 | −4 | +6 |

*mg/mole silver

Less speed change and Dmax loss on keeping and fresh fog reduction were obtained by the addition of Compound A in the precipitation. In addition, there was no change in latent image stability.

Example 2

2.68% I bromoiodide monodispersed tabular emulsions C (control) and D (invention) were similarly precipitated as described in Example 1 with the following modifications: (1) the level of Pluoronic 31R1 in the initial vessel was reduced to 0.11 cc/l; (2) the temperatures for nucleation and growth were 45° C. and 60° C., respectively; (3) the pAg of nucleation was 9.7 and was adjusted to 9.8 before addition of gelatin solution to pAg 9.2; (4) the pH for the ammonia digest was 9.5; (5) the pH for growth was 5.8; (6) the nucleated emulsions were grown for 55.8 minutes instead of 64.6 minutes at pAg 9.2 before addition of AgI seed; (7) the final growth was at pAg 8.7 with 1.68N NaSr for 13.3 minutes instead of pAg 7.7 for 15.7 minutes; and (8) Iridium was not added. Compound A, dissolved in methanol, was added to emulsion D in $AgNo_3$ solutions. These emulsions were monodispersed.

| Emulsions | *Compound A | Mean Size | COV | Mean Thickness | AR | Tabularity |
|---|---|---|---|---|---|---|
| C (Control) | None | 1.13 um | 12% | 0.129 um | 8.8 | 69 |
| D (Invention) | 24.4 | 1.36 um | 14% | 0.105 um | 13.0 | 123 |

*mg/mole silver

Thickness reduction was noticeable and thereby tabularity was increased by the use of Compound A.

Emulsions C and D were sensitized with 100 mg NaCNS, 1013 mg Compound C, 4.4 mg Compound F, 2.18 mg Compound G and 24.2 mg Compound J for one mole of silver at 68° C. for 20 minutes. The emulsions were coated and evaluated as in Example 1 except that they were exposed at 1/50 seconds 5500K. The results shown below indicate that speed change upon keeping was reduced by the use of Compound A.

| Emulsions | *Compound A | Fog | Dmax | Speed | % Dmax | Dspeed |
|---|---|---|---|---|---|---|
| C (Control) | None | 0.04 | 2.43 | 182 | −2 | +19 |
| D (Invention) | 24.36 | 0.04 | 2.41 | 182 | −2 | +8 |

*mg/mole silver

Example 3

A 5% I AgBrI cubic emulsion (Emulsion E) was made via a double jet method. 9 moles of silver halide emulsion were made at constant pAg 7.97 by varying the flow of the salt solution. The silver and salt solutions were added over a period of 35 minutes in a stirred kettle containing 8.3 liters of an aqueous 2% gelatin solution with 900 mg of ripener Compound B. The emulsion was desalted by an ultrafiltration washing technique. The resultant emulsion grains showed perfect cubic structure and were measured to be 0.111 μm (equivalent spherical diameter).

Emulsion F (Invention) was prepared like Emulsion E except a silver nitrate solution containing 24 mg/Ag mole of Compound A dissolved in methanol was added. Unexpectedly, the grains became rounded in the presence of Compound A. The size of the grain was 0.115 μm and the grains lost their cubic characteristics by about 16% when estimated by dye adsorption method similar to the procedure described by H. Philippaerts, et al., Journal of Photographic Science, Vol. 20, p. 215 (1972) and T. Tani, "Journal of Imaging Science, Vol. 29, p. 165 (1985). Therefore, Compound A appeared to restrain <111> surface growth.

The emulsions were chemically sensitized with sulphur and gold, spectrally sensitized to the red region spectrum, and coated with gelatin and cyan dye forming coupler and then evaluated as described in Example 1, except the images were developed for four minutes. Photographic results are shown below. Contrast is an average gamma. Ddmax is change in Dmax.

| Emulsions | *Compound A | Fog | Speed | Dmax | DDmax | Dspeed |
|---|---|---|---|---|---|---|
| E (Control) | None | 0.72 | 276 | 1.00 | −.46 | +35 |
| F (Invention) | 24.0 | 0.11 | 245 | 1.57 | −.11 | +14 |

*mg/mole silver

The fog reduction by Compound A made the emulsion acceptable in terms of photographic utility: higher contrast and good keeping (less Dmax loss and speed gain).

Example 4

For reciprocity control, the emulsions described in Example 3 were doped with varying levels of K2IrCl6 as disclosed in U.S. Pat. No. 4,902,611 (Leubner and White, 1990) as shown below:

| Emulsion | Ir* | Compound A* | Size | Fog | Speed | Contrast | Ddmax | Dspeed |
|---|---|---|---|---|---|---|---|---|
| G | 0.30 | 0.8 | 0.117 | 1.03 | 281 | 0.59 | −.20 | +.13 |
| H | 0.05 | 0.8 | 0.113 | 0.80 | 287 | 0.91 | −.22 | +.11 |
| I | 0.15 | 12.0 | 0.113 | 0.57 | 260 | 1.51 | −.15 | +.16 |
| J | 0.30 | 24.0 | 0.108 | 0.08 | 238 | 1.42 | −.14 | +.18 |
| K | 0.05 | 24.0 | 0.107 | 0.22 | 243 | 1.54 | −.15 | +.11 |
| L | 0.15 | 24.0 | 0.112 | 0.28 | 243 | 1.51 | −.14 | +.13 |
| M | 0.15 | 24.0 | 0.113 | 0.25 | 247 | 1.46 | −.14 | +.11 |

*in mg/silver mole

Increase in fresh fog and lower contrast due to iridium were improved by the introduction of Compound A. As the level of Compound A increased, the change in Dmax due to keeping was also improved and relative cubic characters was decreased.

Example 5

Emulsion N (Invention) was made as follows. The starting kettle contained 6 liters of water, 90 g of gel, 30.4 g of $(NH_4)_2SO_4$, and 6.4 g of NaBr, at 80° C. The pH of the kettle was adjusted to 10.0 before the start of the precipitation. 24 mg of Compound A, dissolved in methanol, per silver mole was added to all $AgNO_3$ solutions. A double-jet run of 0.021 mole of $AgNO_3$ and NaBr was added over a time period of 1.2 minutes controlling the pAg at 8.0. The kettle was held for 1 minute. Then 5.25 moles of $AgNO_3$ and 4.2 moles of NaBr and 1.05 mole of KI were added via a double-jet method into the kettle over a time period of 65.6 minutes. The kettle was held for 10 minutes and the pH adjusted from 10 to 5.5 during that time. The run continued with addition of 0.45 mole of $AgNO_3$ and NaBr in an unbalanced flow with faster $AgNO_3$ addition to change the pAg from 8.0 to 6.3 in a time period of 6 minutes. The run continued with 4.8 moles of $AgNO_3$ and NaBr over 48.5 minutes controlling pAg at 6.3. The emulsion was desalted, pAg was adjusted to 7.6 and pH was adjusted to 5.75. The emulsion had an ECD (equivalent circular diameter) of 1.6 μm and consisted of all octahedral grains.

A comparative example, Emulsion O was made without the addition of Compound A to the $AgNO_3$ solutions. The emulsion was 1.7 μm and contained all cubooctahedra grains.

The x-ray powder diffraction study (XRPD) showed that the invention has a lower iodide containing shell and that the invention has more uniform iodide in both the core and shell as indicated by the narrower full width half maximum (FWHM) as shown below:

| Emulsions | ECD | Shape | % I:FWHM Core | % I:FWHM Shell |
|---|---|---|---|---|
| N (Invention) | 1.7 um | octa | 19.7:0.18 | 0.4:0.26 |
| O (Control) | 1.6 um | cuboocta | 19.4:0.20 | 1.6:0.36 |

The emulsions were chemically sensitized with sulphur and gold. The sensitized emulsions were coated with gelatin and yellow dye forming coupler on a support. The emulsion was stabilized with Compound H. The emulsion layer was protected by a gelatin overcoat and hardened. The coatings were exposed through a step wedge on a 1B sensitometer and processed in Kodak color negative C-41 process.

| Emulsions | Fog | *Speed | Dmax |
|---|---|---|---|
| N (Invention) | 0.11 | 100 | 1.8 |
| O (Control) | 0.97 | 100 | 1.8 |

*0.15 above Dmin

The invention having Compound A reduced the fog considerably without altering speed and Dmax.

Example 6

0.2 micrometer cubic AgCl emulsions P through S were precipitated with Compound A (0.8 mg/mole Ag) added in a variety of ways.

Emulsion P

An AgCl cubic emulsion was made via a double jet method. 9 moles of silver halide were made at a constant pAg of 7.55 by varying the flow of the salt solution. The silver and salt were added over a period of 25 minutes in a stirred kettle containing 7.2 liters of an aqueous 2.5% gelatin solution. The emulsion was desalted by an ultrafiltration technique.

Emulsion O

Emulsion Q was prepared in a similar manner except that 0.8 mg/Ag mole of Compound A was dissolved in methanol and was added to the 3N $AgNO_3$ solution used to prepare the emulsion.

Emulsion R

Emulsion R is the same as Emulsion Q except that the methanolic solution of Compound A was added to the 3N NaCl solution used to prepare the emulsion instead of the 3N $AgNO_3$ solution.

Emulsion S

Emulsion S was the same as Emulsion P except the methanolic solution of Compound A was added to the precipitation kettle before the start of the emulsion precipitation.

The resulting emulsions were sulfur plus gold sensitized, dyed with a sensitizing dye (Compound K) and tested in a black-and-white developer KODAK DK-50. Toe speed was measured at 0.1 above Dmin.

| Emulsions | Where Added | Toe Speed | Fog |
|---|---|---|---|
| P (Control) | none | 2.54 | 0.44 |
| Q (Invention) | 3N AgNO3 | 2.56 | 0.35 |
| R (Invention) | 3N NaCl | 2.31 | 0.06 |
| S (Invention) | Kettle | 2.34 | 0.06 |

Compared to the control emulsion, the addition of Compound A during precipitation reduced fog.

Example 7

Pure silver chloride cubic emulsions T through Y were precipitated by equimolar addition of 3.8 molar silver nitrate and sodium chloride solutions into a reactor containing 195 g of bone gelatin, 35.9 g of sodium chloride, 6969 ml of distilled water, and Compound B at a temperature of 68.3° C. Initial temperature and pAg was maintained constant throughout the precipitation. Feed solution flows and the amount of ripener (Compound B) were adjusted to obtain 0.72 micrometer silver chloride cubes. Various levels of Compound A, dissolved in methanol, were added to the $AgNO_3$ feed solution. The extent of reduction sensitized fog was determined by adding 4 mg $KAuCl_4$ per mole of silver followed by a heat digestion at 60° C. for 55 minutes. The reduction sensitized fog was reduced by the addition of Compound A as shown below:

| Emulsion Number | Compound A* | Fog |
|---|---|---|
| T (Control) | 0.0 | 0.18 |
| U (Invention) | 0.4 | 0.15 |
| V (Invention) | 4 | 0.13 |
| W (Invention) | 8 | 0.10 |
| X (Invention) | 20 | 0.08 |
| Y (Invention) | 40 | 0.06 |

*mg/silver mole

As the concentration of Compound A increased, reduction sensitized fog was reduced.

Example 8

Iridium doped 2% I bromoiodide emulsions digested with ammonia were prepared by the following procedure.

To a precipitation vessel was added 6.72 l of a distilled water solution that was 546.4 g sodium bromide, 26.72 g potassium iodide, and contained 248 g bone gelatin. The solution was stirred and pH was measured at 5.77 at 40° C. The temperature was increased to 79° C. A 1.5 molar silver nitrate solution was added through a jet at a constant flow for 41 minutes with 8 moles of silver added. A 3 molar sodium bromide solution was added through a second jet with the following flow rates for a total of 41 minutes; 0.071 moles for 2.5 minutes, 0.51 moles for 10 minutes with increasing flow rate of 1.52x, 0.40 moles for 5 minutes with increasing flow rate of 0.68x, 0.43 moles for 5 minutes with increasing flow rate of 0.22x, 0.46 moles for 5 minutes with increasing flow rate of 0.7x, and 0.69 moles for 8.5 minutes with decreasing flow rate of −1.271x,. At the end of the silver run, 100 cc of aqueous ammonium sulfate solution (0.17 g/ml) was added into the vessel followed by addition of 6.5 ml/Ag mole of 15N ammonium hydroxide solution. After holding for 5 minutes, pH was adjusted to 6.0 and the emulsion was washed.

Due to the ammonia digestion, these emulsions are prone to reduction sensitization fog. To lower fog, Compound A, dissolved in methanol, was added through the silver nitrate solutions. Grain size of the emulsions was 1.63 μm and 1.5 μm for Emulsions Z and CC, respectively. Both emulsions were sensitized with sulfur, gold and blue spectral sensitizer Compound C. For comparison, Compound A was added to the sensitized emulsion Z prior to coating as described in U.S. Pat. No. 3,397,986. Coatings were prepared and evaluated as described in Example 1, except that 89 mg/ft$^2$ silver and 180 mg/ft$^2$ Compound I were coated. The results are shown below:

| Emulsions | *Compound A | Where Added | Fog | Dmax | Speed | Contrast |
|---|---|---|---|---|---|---|
| Z (Control) | none | none | 1.63 | 0.15 | 0 | 0 |
| AA (Control) | 24 | melt | 1.61 | 0.21 | 0 | 0 |
| BB (Control) | 90 | melt | 1.59 | 0.23 | 0 | 0 |
| CC (Invention) | 24 | precipitation | 0.42 | 1.43 | 215 | −149 |

*in mg/silver mole

The control emulsion Z showed too high fog to determine speed and contrast. The comparative coatings, AA and BB prepared as taught by Millikan and Herz (U.S. Pat. No. 3,397,986) did not reduce fog significantly. Only when added to the emulsion during precipitation, did Compound A provide acceptable photographic results (fog, Dmax, and speed).

Kodak C-41 Color negative process of the above coatings provided similar conclusions as for the Kodak E6 process:

| Emulsions | Fog | *Speed |
|---|---|---|
| Z (Control) | 0.98 | 246 |
| AA (Control) | 1.00 | 231 |
| BB (Control) | 0.98 | 220 |
| CC (Invention) | 0.18 | 264 |

*contrast normalized speed

The mode of spectral sensitization was not important. Emulsions Z and CC were sensitized by adding blue spectral sensitizer Compound C before and after heat digestion.

| Emulsions | Sensitization | % fog** | Dmax | Speed | % Dmax | Dspeed | # LIK |
|---|---|---|---|---|---|---|---|
| Z (Control) | 67 C. 20 min/dye | 92 | 0.25 | 0 | * | * | * |
| AA (Invention) | 67 C. 20 min/dye | 19 | 2.27 | 237 | −8% | 2 | −5 |
| BB (Control) | dye/73 C. 20 min | 76 | 0.7 | 219 | * | * | * |
| CC (Invention) | dye/73 C. 20 min | 19 | 2.26 | 234 | −17% | −9 | +4 |

*not measurable due to high fog
**percent silver fogged of total silver coated
Latent image keeping speed change at 78 F. and 50% relative humidity for 2 weeks Regardless of how Emulsion CC was spectrally sensitized, when doped with Compound A during precipitation it provided lower fresh fog and fog growth during high temperature keeping, and acceptable LIK.

Example 9

Fine 3.4% I bromoiodide Emulsions, DD and EE were prepared similarly as described in Example 8 with a lower temperature of 44° C., higher iodide of 3.4% I, and 28 minute precipitation time. Similar fog reduction was observed as in Example 8.

| Emulsions | *Compound A | Size, μm | Fog | Speed |
|---|---|---|---|---|
| DD (Control) | none | 0.364 | 0.21 | 325 |
| EE (Invention) | 24 | 0.342 | 0.14 | 323 |

*mg/silver mole

Example 10

Fine grain 4.8% I bromoiodide core/shell emulsions FF through JJ were precipitated in a reactor containing ammonia before the start of the precipitation. After growing crystals in the presence of the ammonia for a desired period, pH was adjusted to below 6. Then $AgNO_3$ and NaBr salt were added in order to grow crystals further at a desired pAg. A methanolic solution of Compound A was added to the AgNO3 solution throughout precipitation. Due to the high pH of the added ammonia, these emulsions are prone to reduction sensitization fog. The emulsions were sensitized with blue or red sensitizing dyes and tested as described in Example 1. The fog reduction by Compound A was apparent.

| Emulsions | Sens | Size, μm | *Compound A | Speed | Fog |
|---|---|---|---|---|---|
| FF (Control) | Blue | 0.154 | 0 | 192 | 0.57 |
| GG (Invention) | Blue | 0.155 | 24 | 181 | 0.19 |
| HH (Control) | Red | 0.159 | 0 | 242 | 0.22 |
| II (Invention) | Red | 0.156 | 0.8 | 247 | 0.13 |
| JJ (Invention) | Red | 0.156 | 24 | 245 | 0.09 |

*mg/silver mole

Example 11

0.44 μm 2% I bromoiodide emulsions KK, LL, and MM were prepared similarly as described in Example 9, except that iridium was added after 90% of the total silver precipitation and ammonia digestion was not performed. The emulsions were sensitized with 42 mg NaSCN, 22 mg Compound E, 7.0 mg sodium thiosulfate pentahydrate, and 3.5 mg potassium tetrachloroaurate (all per mole Ag) at 70° C. for 20 minutes. Red sensitizing dye (Compound L) was added, coated with cyan dye forming coupler (Compound M), and tested as described in Example 1.

| Emulsions | *Compound A | Fog | Dmax | Speed | % Dmax | Dspeed |
|---|---|---|---|---|---|---|
| KK (Control) | None | 0.35 | 2.00 | 246 | −81 | −68 |
| LL Invention) | 12 | 0.25 | 2.15 | 245 | −51 | −26 |
| MM (Invention) | 24 | 0.26 | 2.15 | 250 | −47 | −29 |

*mg/silver mole

Compound A, when added in the precipitation, provided significant reductions in fresh fog without speed loss, and significantly less fog growth (less %Dmax loss) as well as less speed loss when coatings were stored at 120° and 50% relative humidity for 2 weeks.

Example 12

Emulsions NN through PP were prepared as described in Example 7, except that after the initial 5 minutes of the double-jet precipitation, a silver solution containing various amounts of 5-thioctic acid (Compound N) and 6-thioctic acid (Compound O) dissolved in methanol was used. The emulsions were sensitized with 280 mg of blue sensitizing dye (Compound D), 0.75 g KBr, 2.5 mg sodium thiosulfate pentahydrate, and 1.25 mg potassium tetrachloroaurate (per silver mole) at 80° C. for 20 minutes. After heat ramp, 86 mg of 1-(3-acemidophenyl)-5-mercaptotetrazole per silver mole was added. The emulsions were coated on a paper support and were processed in Kodak RA-4 chemistry (Research Disclosure Vol 308, 1989, p 933. Speed was taken at density=1.

| Emulsions | Addendum* | Fog | Speed | Contrast |
|---|---|---|---|---|
| NN (Control) | none | 0.16 | 122 | 1.22 |
| OO (Invention) | Compound N at 0.01 | 0.09 | 117 | 1.66 |
| PP (Invention) | Compound O at 0.01 | 0.07 | 113 | 1.83 |

*concentrations in mmole per silver mole

At the most preferred concentration, 0.01 mmole per silver mole, unacceptable high fog was reduced by both compounds N and O to practical levels for color paper applications.

Example 13

Emulsions QQ through WW were prepared as described in Example 12, except that higher concentrations of 5-thioctic acid (Compound N) were used.

| Emulsion | Compound N* | Size | Shape | Figure |
|---|---|---|---|---|
| QQ | 0 | 0.728 | rounded cube | |
| RR | 0.010 | 0.743 | rounded cube | |
| SS | 0.060 | 0.737 | cubooctahedra | |
| TT | 0.120 | 0.715 | cubooctahedra | |
| UU | 0.322 | 0.693 | cubooctahedra | |
| VV | 0.970 | 0.729 | cubooctahedra + (110) edge | |
| WW | 2.910 | 0.727 | cubooctahedra + | |

-continued

| Emulsion | Compound N* | Size | Shape | Figure |
|---|---|---|---|---|
| | | | (110) face | |

*concentrations are in mmole per silver mole 5-thioctic acid affects the growth of (111) and (110) crystallographic faces at the same time, leading to the morphology with all those faces present (at concentration of 2.91 mmol/Ag mol). At lower concentrations (0.3–1 mmol/Ag mol), well-developed cubooctahedra are formed, whereas at yet lower concentrations the share of (111) face is decreasing down to that of the control emulsion QQ prepared without the Compound N.

Example 14

AgCl Emulsions XX through AAA were prepared as described in the Example 7 except that $2\times10^{-6}$ g of dicesium pentachloro nitrosyl osmate per silver mole was added through the salt solutions as described by McDugle, et al., U.S. Pat. No. 4,933,272. The amount of Compound A added to each silver nitrate solution and the resulting fog levels (tested as described in Example 7) are shown below.

| Emulsions | *Compound A | Fog |
|---|---|---|
| XX (Control) | None | 0.29 |
| YY (Invention) | 0.2 | 0.20 |
| ZZ (Invention) | 0.4 | 0.16 |
| AAA (Invention) | 0.8 | 0.16 |

*mg/Ag mole

As shown above, Compound A reduced fog in AgCl emulsions doped with osmium.

While the invention has been described in detail and with reference to specific embodiments thereof, it will be apparent to one skilled in the art that various changes and modifications can be made therein without departing from the spirit and scope thereof.

Example 15

A pure silver chloride emulsion (Emulsion BBB, Control) was precipitated by a double jet technique with the use of 1,8-dithiaoctanediol as ripener. The resultant cubic emulsion had 0.75 μm edgelength. It was then chemically and spectrally sensitized, as described below. In another emulsion (Emulsion CCC, Control) prepared, as described above, mercuric chloride was added to the silver feed solution. This emulsion was sensitized, as described below.

Two other emulsions, (Emulsion DDD & EEE), were prepared, as described above, but after the initial 5 minutes of precipitation, a silver solution containing various amounts of 6-thioctic acid (Compound O), dissolved in methanol, were added. With this addition, the usual rounded cubic morphology with a higher percentage of (111) crystallographic face at the corners changed to a much sharper cubic morphology bounded almost exclusively by (100) crystallographic faces.

All of the emulsions were sensitized by the addition of gold sulfide and ripening for 65 minutes at an elevated temperature, during which time a cyanine yellow sensitizing dye was introduced as well as 1-(3-acetomidophenyl)-5-mercaptotetrazole and potassium bromide. Sodium chloride was added to all the emulsions prior to coating. Immediately prior to coating, the emulsions were dual mixed with a yellow coupler dispersion which was stabilized by benzenosulfonic acid. All of the emulsions were coated at 26 mg of silver, 100 mg of yellow coupler and 77 mg of gelatin per square foot on a resin coated paper support and were subsequently subjected to sensitometric gradation exposure through a set of Kodak filters. The exposure time was 1/10 second. Processing was by the rapid access Kodak RA-4 process, as described in Research Disclosure, Vol. 308, p. 933, 1989. Speed was measured by 1.0 density.

TABLE 1

| | | Photographic Properties | | | |
|---|---|---|---|---|---|
| | | Fresh | | Incubation 3 Day/ 100° F./50 RH | |
| Emulsion | Compound O (μmole/Ag Mole) | Speed | Fog | Δ Speed | Δ Fog |
| BBB (Control) | 0 | 209 | 0.160 | 9 | 0.060 |
| CCC (Control) | 0 | 209 | 0.070 | 9 | 0.105 |
| DDD (Invention) | 1.0 | 206 | 0.065 | 12 | 0.065 |
| EEE (Invention) | 0.1 | 206 | 0.140 | 10 | 0.080 |

Example 16

Emulsion FFF (Invention) and Emulsion GGG (Invention) were made as follows. The starting kettle contained 6 liters of water, 90 g of gel, 30.4 g of $(NH_4)_2SO_4$, and 6.4 g of NaBr, at 80° C. The pH of the kettle was adjusted to 10.0 before the start of the precipitation. A double-jet run of 0.021 mole of $AgNO_3$ and NaBr was added over a time period of 1.2 minutes controlling the pAg at 8.0. The kettle was held for 1 minute. Then 5.25 moles of $AgNO_3$ and 4.2 moles of NaBr and 1.05 mole of KI were added via a double-jet method into the kettle over a time period of 65.6 minutes. The kettle was held for 10 minutes and the pH adjusted from 10 to 5.5 during that time. The run continued with addition of 0.45 mole of $AgNO_3$ and NaBr in an unbalanced flow with faster $AgNO_3$ addition to change the pAg from 8.0 to 6.3 in a time period of 6 minutes. The run continued with 4.8 moles of $AgNO_3$ and NaBr over 48.5 minutes controlling pAg at 6.3. The emulsion was desalted, pAg was adjusted to 7.6 and pH was adjusted to 5.75. The emulsion had an ECD (equivalent circular diameter) of 1.6 μm and consisted of all cubo-octahedral grains. For Emulsion FFF, 1 mg of Compound A/mol Ag was added to all of the salt solutions except the silver salt solutions. For Emulsion GGG, 40 mg of Compound A was dissolved in 10 cc of methanol and added as a dump after the NaBr and KI addition and before the pH adjustment.

A comparative example, Emulsion HHH (Control) was made without the addition of Compound A. The emulsion was 1.7 μm and contained all cubo-octahedral grains.

The x-ray powder diffraction study (XRPD) showed that the invention (Emulsion GGG), which had the addition of Compound A after the BrI core, has a lower iodide containing shell and that the invention (Emulsion FFF), with the addition of Compound A during the whole time of the make, has more uniform iodide in both the core and shell as indicated by the narrower full width half maximum (FWHM) as shown below. These two examples clearly show that Compound A is the factor causing the change in FWHM and the more uniform iodine distribution.

| Emulsion | ECD | Shape | % I:FWHM | % I:FWHM | Fog | Speed | Dmax |
|---|---|---|---|---|---|---|---|
| FFF (Invention) | 1.6 μm | cubo-octa | 19.9:0.179 | 1.3:0.294 | 0.21 | 95 | 1.8 |
| GGG (Invention) | 1.6 μm | cubo-octa | 19.5:0.206 | 1.1:0.295 | 0.44 | 98 | 1.8 |
| HHH (Control) | 1.6 μm | cubo-octa | 19.4:0.200 | 1.6:0.360 | 0.97 | 100 | 1.8 |

The emulsions were chemically sensitized with sulphur and gold. The sensitized emulsions were coated with gelatin and yellow dye forming coupler on a support. The emulsion was stabilized with Compound H. The emulsion layer was protected by a gelatin overcoat and hardened. The coatings were exposed through a step wedge on a 1B sensitometer and processed in Kodak color negative C-41 process.

The invention having Compound A reduced the fog considerably without altering speed and Dmax.

What is claimed is:

1. A method of making a photographic silver halide emulsion comprising:

precipitating a silver halide emulsion; and adding to the silver halide emulsion before or during precipitation a non-labile chalcogen compound represented by Formula I:

$$R^1—X^1—X^2—R^2 \quad \text{(Formula I)}$$

where $X^1$ and $X^2$ are independently S, Se, or Te; and $R^1$ and $R^2$, together with $X^1$ and $X^2$, form a ring system, or are independently substituted or unsubstituted cyclic, acyclic or heterocyclic groups.

2. The method of claim 1 wherein $R^1$ and $R^2$ are independently substituted alkyl or aryl groups; the dichalcogenide molecule is symmetrical and the molecular weight is greater than 210 g/mol.

3. The method of claim 1 wherein the dichalcogenide compound is a disulfide compound represented by Formula II or III:

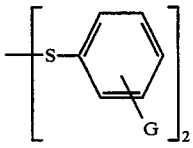

(Formula II)

where G is independently in an ortho, meta, or para position on the aromatic nucleus relative to the sulfur and is hydrogen, hydroxy, $SO_3M$ or $NR^3R^4$;

M is hydrogen, or an alkaline earth, alkylammonium or arylammonium cation;

$R^3$ is hydrogen, or a substituted or unsubstituted alkyl or aryl group;

$R^4$ is hydrogen, O═C—$R^5$, or O═C—N—$R^6R^7$; and $R^5$, $R^6$, and $R^7$ are independently hydrogen, or hydroxy, or an unsubstituted alkyl, or aryl group, or a substituted or unsubstituted fluoroalkyl, fluoroaryl, carboxyalkyl, carboxyaryl, alkylthioether, arylthioether, sulfoalkyl, or sulfoaryl group or the free acid, alkaline earth salt or alkylammonium or arylammonium salt of the aforementioned groups,

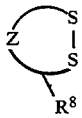

(Formula III)

where Z contains substituted or unsubstituted carbon or hetero atoms sufficient to form a ring; and $R^8$ is a substituted or unsubstituted alkyl or aryl group of 2 to 10 carbon atoms, or the free acid, alkaline earth salt, arylammonium or alkylammonium salt of the aforementioned groups.

4. The method of claim 3 wherein the disulfide is represented by Formula II and the molecule is symmetrical and G is in an ortho, meta, or para position on the aromatic nucleus relative to the sulfur and is $NR^3R^4$; and $R^4$ is hydrogen, or O═C—$R^5$.

5. The method of claim 4 wherein G is in a para position relative to sulfur, $R^3$ is hydrogen or methyl, $R^4$ is O═C—$R^5$ and $R^5$ is an alkyl group of 1 to 10 carbon atoms, an aryl group of 6 to 10 carbon atoms or a trifluoromethyl group.

6. The method of claim 5 wherein the disulfide compound is p-acetamidophenyl disulfide.

7. The method of claim 3 wherein the disulfide compound is represented by Formula III and $R^8$ is a substituted or unsubstituted carboxyalkyl, carboxyaryl, alkyl ester, or aryl ester group of 2 to 10 carbon atoms, or the free acid, alkaline earth salt, arylammonium or alkylammonium salt of the aforementioned groups.

8. The method of claim 7 wherein Z comprises carbon atoms sufficient to form a ring and $R^8$ is a substituted or unsubstituted alkyl or aryl group of 4 to 8 carbon atoms, or the free acid, alkaline earth salt, arylammonium or alkylammonium salt of the aforementioned groups.

9. The method of claim 8 wherein $R^8$ is a substituted or unsubstituted carboxyalkyl, carboxyaryl, alkyl ester, or aryl ester group of 4 to 8 carbon atoms, or the free acid, alkaline earth salt, arylammonium or alkylammonium salt of the aforementioned groups.

10. The method of claim 9 wherein the disulfide compound is 5-thioctic acid or 6-thioctic acid.

11. The method of claim 3 wherein the amount of the disulfide compound added is $1\times10^{-7}$ to $1\times10^{-2}$ mol/mol Ag.

12. The method of claim 3 wherein the amount of the disulfide compound added is $1\times10^{-6}$ to $3\times10^{-4}$ mol/mol Ag.

13. The method of claim 3 wherein the amount of the disulfide compound added is $10^{-5}$ to $10^{-3}$ mol/mol Ag.

14. The method of claim 3 wherein the silver halide emulsion is a reduction sensitized emulsion.

15. The method of claim 3 wherein the silver halide emulsion is doped with a Group VIII metal.

16. The method of claim 3 wherein the silver halide emulsion is precipitated in the presence of ripeners.

17. The method of claim 1 wherein precipitating the silver halide emulsion comprises adding at least one non-silver salt solution to the emulsion and wherein the dichalcogenide compound is first added to the non-silver salt solution and the dichalcogenide containing salt solution is then added to the emulsion.

18. A photographic silver halide emulsion prepared by the method described in any one of claims 1 through 17.

* * * * *